United States Patent [19]

Mueller et al.

[11] Patent Number: 4,829,782

[45] Date of Patent: May 16, 1989

[54] ICE HARVESTING/WATER CHILLER MACHINE

[75] Inventors: Paul Mueller, Springfield; William R. Waynick, Walnut Grove; Phillip G. Shirey, Nixa, all of Mo.

[73] Assignee: Paul Mueller Company, Springfield, Mo.

[21] Appl. No.: 238,094

[22] Filed: Aug. 29, 1988

[51] Int. Cl.[4] ..... F25C 1/12

[52] U.S. Cl. ..... 62/347; 62/523; 62/525; 165/115

[58] Field of Search ..... 165/115, 118; 62/347, 62/523, 525

[56] References Cited

U.S. PATENT DOCUMENTS

| | | | |
|---|---|---|---|
| 873,189 | 10/1907 | Tobey et al. | 165/115 X |
| 968,550 | 8/1910 | Gille | 116/115 |
| 1,694,370 | 12/1928 | Burdick | 62/525 X |
| 1,712,085 | 5/1929 | Litle, Jr. | 62/523 |
| 1,976,963 | 10/1934 | Persons | 62/59 |
| 2,113,359 | 4/1938 | Stebbins | 62/59 |
| 2,448,453 | 8/1948 | Morrison | 62/59 |
| 3,546,896 | 10/1968 | Hagen et al. | 62/347 |
| 3,587,241 | 6/1971 | Hagen | 62/63 |
| 3,797,267 | 11/1972 | Hagen | 62/233 |
| 3,842,993 | 10/1974 | Hagen | 62/344 |
| 3,972,201 | 8/1976 | Datis | 62/54 |
| 4,044,568 | 8/1977 | Hagen | 62/73 |
| 4,087,228 | 5/1978 | Datis | 431/5 |
| 4,153,105 | 5/1979 | Schroder | 165/104 S |
| 4,153,404 | 5/1979 | Ottman | 425/256 |
| 4,168,937 | 9/1979 | Hagen | 414/298 |
| 4,172,366 | 10/1979 | Ohling | 165/115 X |
| 4,302,944 | 12/1981 | Gainer | 62/59 |
| 4,522,039 | 6/1985 | McNeill | 62/320 |
| 4,531,380 | 6/1985 | Hagen | 62/326 |
| 4,566,290 | 1/1986 | Otterbein | 62/304 |
| 4,622,832 | 11/1986 | Hagen | 62/344 |

*Primary Examiner*—William E. Tapolcai

*Attorney, Agent, or Firm*—Rogers, Howell, Moore & Haferkamp

[57] ABSTRACT

An ice harvesting/water chiller machine with an improved evaporator assembly having a plurality of plate-type heat exchangers oriented vertically in face-to-face parallel relation. A water reservoir is located above the heat exchangers. Water is distributed from the reservoir downwardly to flow over the outside surfaces of the heat exchangers to effect a substantially even distribution of water over the outside surfaces as it flows downwardly thereover. Cold refrigerant is distributed to the tops of the heat exchangers to cascade downwardly over the inside surfaces of the heat exchangers to effect a substantially even distribution of refrigerant over the inside surfaces as it cascades downwardly thereover. A cold refrigerant feed tube extends across the top of each heat exchanger substantially the entire width thereof. The tube has spaced openings along the tube over substantially the entire width of the heat exchanger which openings communicate with the interior of the heat exchanger. The tube receives cold refrigerant and distributes it through the openings into the interior of the heat exchanger to cascade downwardly over the inside surfaces thereof.

6 Claims, 4 Drawing Sheets

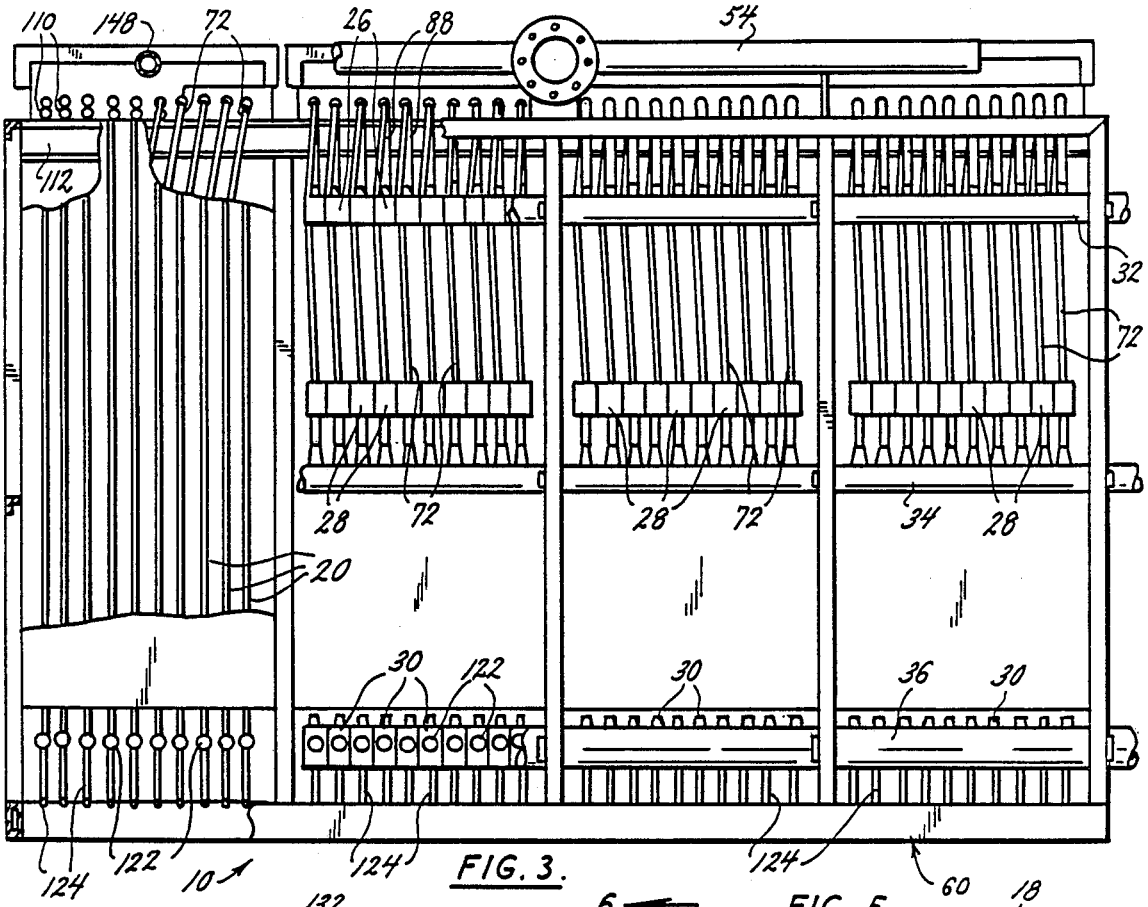
FIG. 3.
FIG. 5.
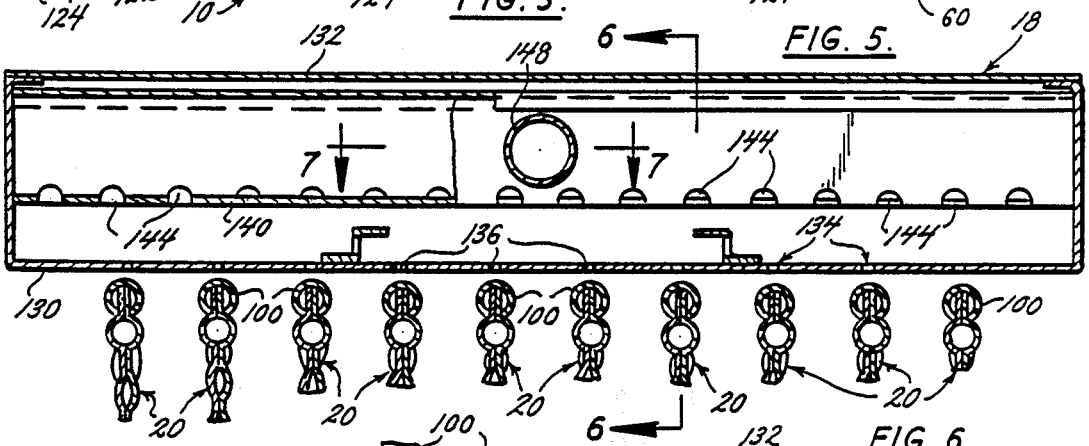
FIG. 6.
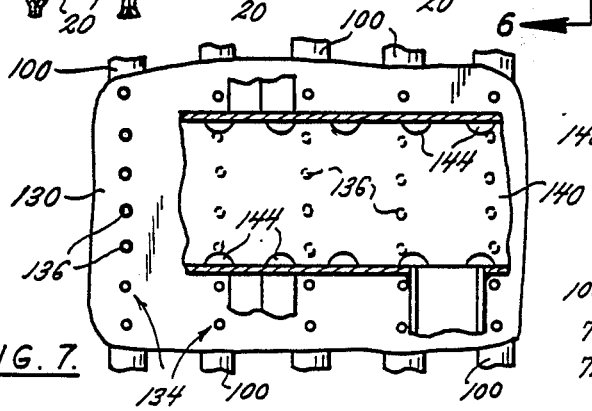
FIG. 7.
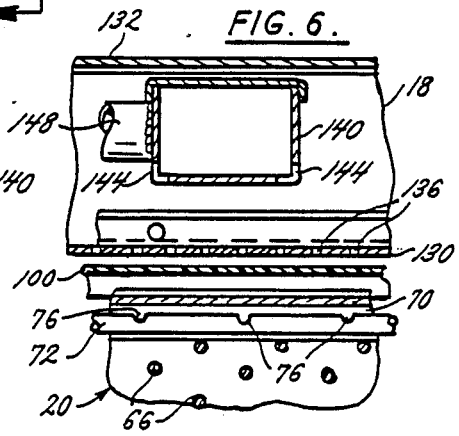

ICE HARVESTING/WATER CHILLER MACHINE

BACKGROUND AND SUMMARY OF THE INVENTION

This invention relates to an ice harvesting/water chiller machine of the type for producing large quantities of ice and/or chilled water and where the ice may be used for thermal energy storage for cooling.

Thermal energy storage has been used for many years. In the past it was economically feasible with certain classic cooling applications such as churches, theatres, and dairies to utilize the stored cooling effect of small refrigeration systems operated over long periods of time to meet large cooling requirements of short duration. In more recent years, thermal energy storage has been used to take advantage of utility pricing policies. Utilities have instituted time-of-use rate schedules to encourage the shifting of electrical demand to off-peak, low electrical demand periods of the day, periods during which utilities have excess generating capacity. Large cooling requirements are prime candidates for electrical load shifting of this type. By shifting electrical demand to off-peak hours, it is possible to obtain cooling during peak hours at close to off-peak costs.

Hence, as with other ice harvesting machines, the ice harvesting machine of the present invention is used to produce large quantities of ice during off-peak periods when the cost of electricity is relatively low, and store the ice for cooling during peak periods when the cost of electricity is relatively high, thus avoiding use of large amounts of electricity during high cost periods.

Ice harvesting machines are known in the art. U.S. Pat. Nos. 4,622,832, 4,531,380, and 2,113,359 disclose such machines_where cold refrigerant is distributed over the outer surfaces of vertical tubes, and ice is formed on the inside of the tubes. Other patents disclose such machines using vertical plate-type heat exchangers for forming the ice. Examples are U.S. Pat. Nos. 4,044,568, 3,566,896 and 2,448,453. U.S. Pat. No. 3,546,896 discloses a "pillowed" plate-type heat exchanger where refrigerant is fed within the heat exchanger and water flows from an upper reservoir down over the outer surfaces.

The ice harvesting/water chiller machine of the present invention represents an improvement over such prior machines in providing a machine that is exceptionally efficient for producing large quantities of ice and/or chilled water utilizing an improved evaporator assembly.

Generally, the machine of the present invention includes a storage tank for collecting and storing ice or chilled water produced by the machine for use such as in room cooling during peak load hours, and a refrigeration system for producing the ice and depositing it into the storage tank. The refrigeration system includes an improved evaporator assembly having a plurality of plate-type heat exchangers oriented vertically in face-to-face, parallel, relation above the tank. Each heat exchanger is of the "pillowed" type formed from multiple plates spot welded together at locations spaced uniformly over substantially the entire heat exchanger. The heat exchanger is then inflated so as to pillow between the spot welds to form interior passages between the plates for the flow of refrigerant therethrough.

The assembly further generally includes a water reservoir above the heat exchangers. Water is distributed from the reservoir downwardly to flow over the outside surfaces of the heat exchangers to effect a substantially even distribution of water over the outside surfaces as it flows downwardly thereover. Cold refrigerant is distributed to the tops of the heat exchangers and cascades downwardly over the inside surfaces through the pillowed passages to effect a substantially even distribution of refrigerant over the inside surfaces as it cascades downwardly thereover. To provide such distribution a tube extends across the top of each heat exchanger. The tube has spaced openings along the tube over substantially the entire width of the heat exchanger. These openings communicate with the interior of the heat exchanger. Cold refrigerant is fed through the tube and distributed through the openings into the interior passages of the heat exchanger and cascades downwardly over the inside surfaces thereof, thus cooling the water as it flows downwardly over the outer surfaces.

After a build up of ice of a predetermined thickness on the outer surfaces of the heat exchangers, hot gas is cycled into the interior passages to release the ice which falls into the storage tank below.

The improved evaporator assembly of the present invention produces an exceptionally uniform build up of ice over substantially the entire outer surfaces of each heat exchanger, and does so at high efficiency due to the uniform flow of both cold refrigerant and water over the heat exchanger surfaces.

DESCRIPTION OF THE DRAWINGS

FIG. is generally a block diagram illustrating an ice harvesting/water chiller machine of the present invention.

FIG. 3 is a front elevation view with portions broken away of the evaporator assembly.

FIG. 5 is a view in section taken generally along the line 5—5 of FIG. 4.

FIG. 6 is a view in section taken generally along the line 6—6 of FIG. 5.

FIG. 7 is a view in section taken generally along the line 7—7 of FIG. 5.

DETAILED DESCRIPTION OF A PREFERRED EMBODIMENT

Figure 1:
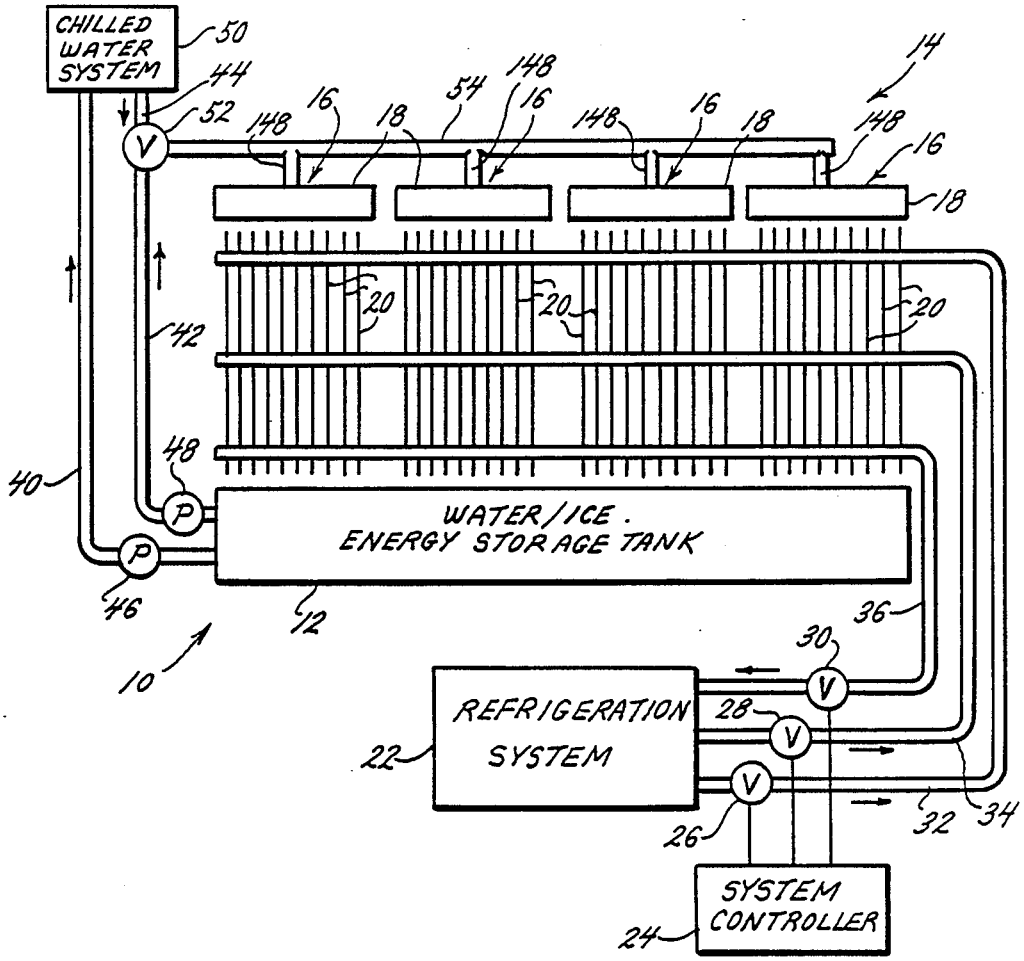
Figure 2:
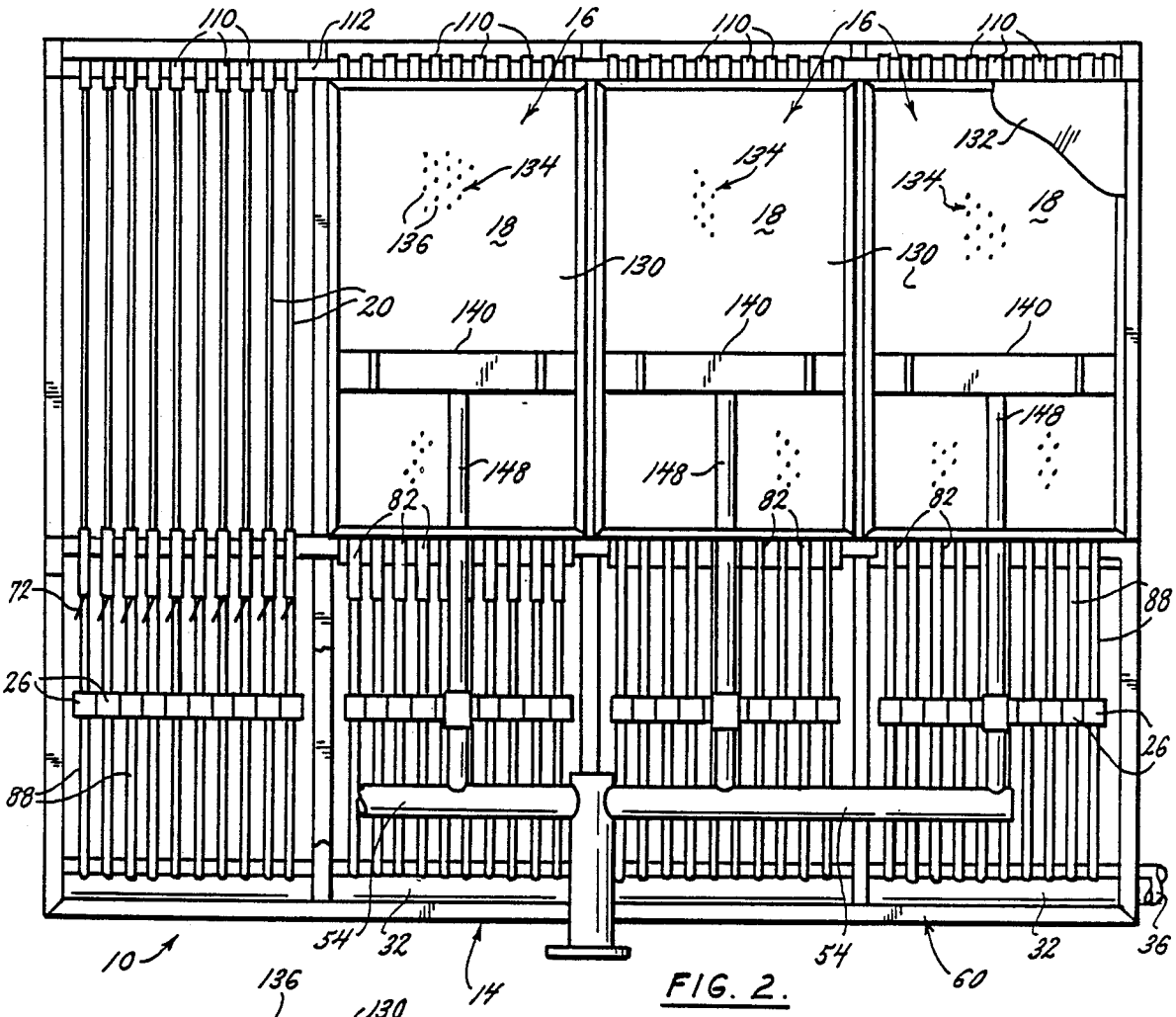
FIG. 2 is a top view with portions broken away of an evaporator assembly of the present invention.
Figure 9:
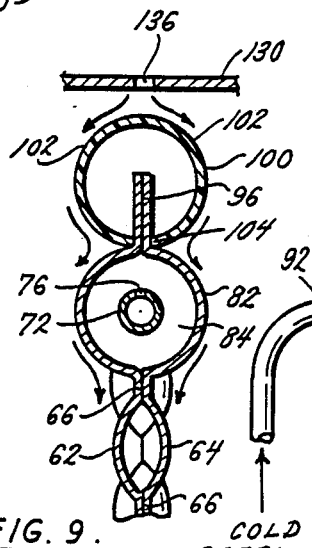
FIG. 9 is a view in section taken generally along the line 9—9 of FIG. 8.
Figure 8:
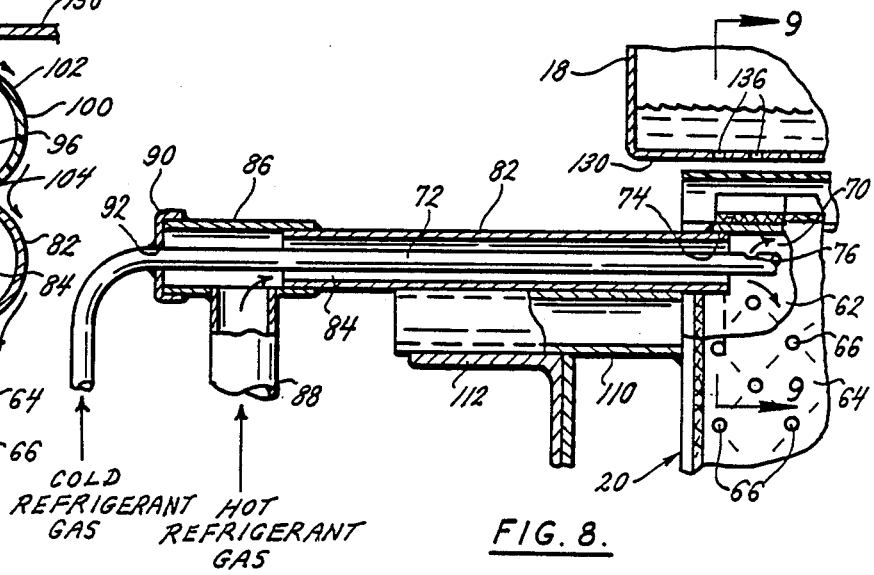
FIG. 8 is a view in section of an upper corner of a heat exchanger showing the hot and cold refrigerant inlets.
Figures 4, 10:
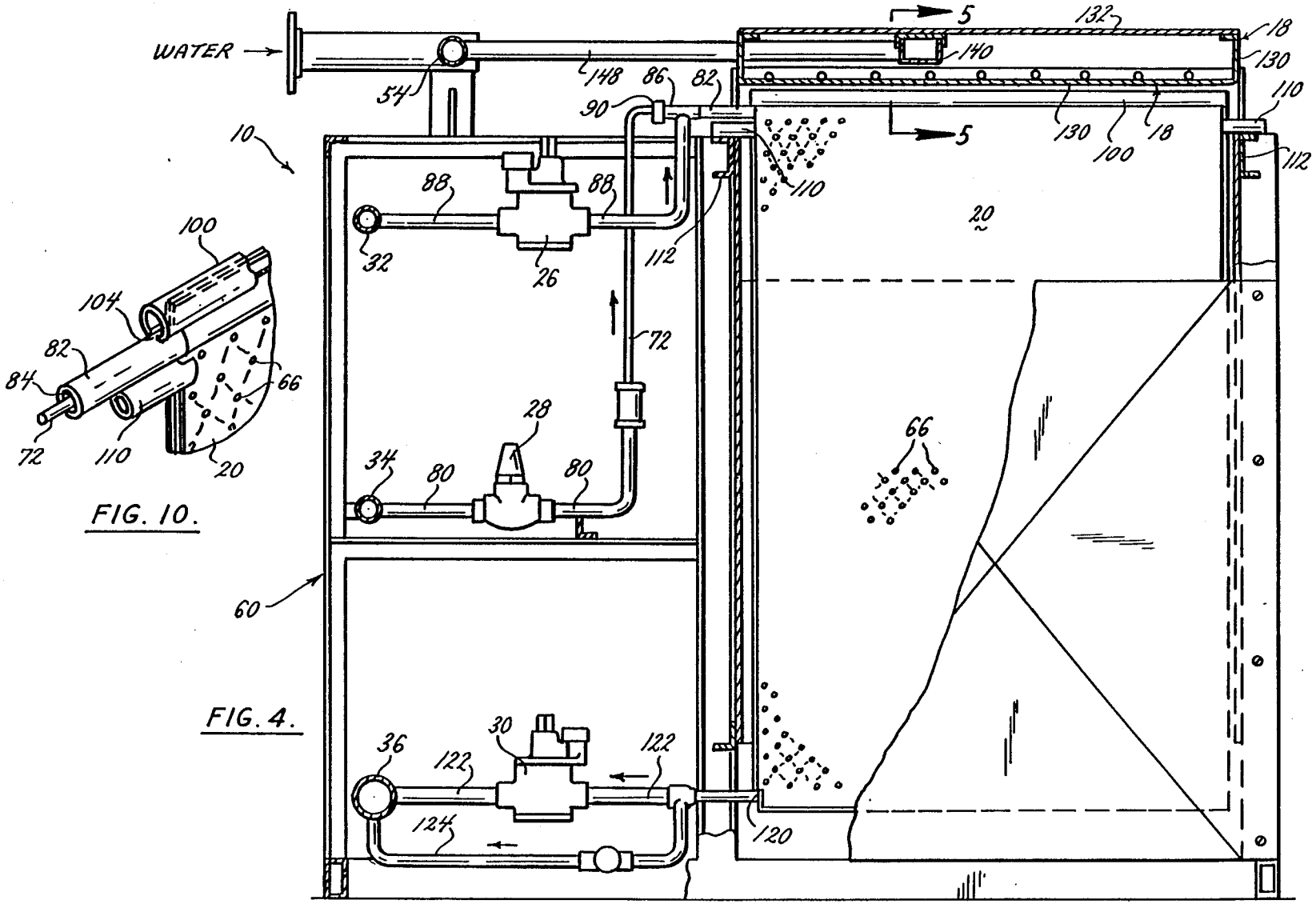
FIG. 4 is a right side elevation view with portions broken away of the evaporator assembly.
FIG. 10 is a perspective view of an upper corner of the heat exchanger showing the hot and cold refrigerant feeds and other structures.

An ice harvesting/water chiller machine of the present invention is generally shown by the block diagram of FIG. 1. The machine 10 includes a water/ice energy storage tank 12 into which ice produced by the machine is deposited for storage and later use during off-peak power periods such as for producing chilled water or for room cooling. Above the tank is an evaporator assembly 14 which is comprised of a plurality of evaporator modules 16. Each module includes an upper water reservoir 18 and a plurality of plate-type heat exchangers 20.

The evaporator assembly is actually part of a refrigeration system 22 which has conventional components such as compressor, condenser, high side float, low pressure receiver, valves, and associated components, and therefor will not be described.

The machine further includes a system controller 24 which may be of the solid state electronic, programmable type and which controls the operation of various valves 26, 28 and 30. The valve 26 is in a feed line 32 and controls the flow of hot gas refrigerant to the evaporator assembly. The valve 28 is in a feed line 34 and controls the flow of cold refrigerant to the evaporator assembly The valve 30 is in a feed line 36 and controls the flow of refrigerant from the evaporator assembly.

The machine also includes feed lines 40, 42, and 44, and pumps 46 and 48 which are part of a chilled water system 50. Hence, chilled water from the storage tank 12 may be pumped by way Of pump 46 and feed line 40 for use in the chilled water system, and also may be fed from the chilled water system by way of feed line 44, or pumped from the storage tank by way of pump 48 and feed line 42 to the reservoirs 18 by way of a valve 52 and feed lines 54 for use in producing ice.

The evaporator assembly 14 of the present invention will be more fully described with reference to figures 2–10. The assembly has a supporting frame 60 for supporting the various components of the assembly. The evaporator modules 16 are supported across the length of the frame. Each plate-type heat exchanger 20 is of the "pillowed" type as described in U.S. Pat. No. 3,458,917, and hence is formed of at least 2 plates 62 and 64 (FIG. 9) spot welded together by spot welds 66 which are spaced uniformly over the entire heat exchanger. The edges of the sheets have seam welds to fully seal the perimeter of the heat exchanger except for the inlets and outlets as will be described. After the sheets are welded together, the heat exchanger is inflated causing the sheets to pillow between the welds thus producing internal passages for the flow of refrigerant therethrough.

Just beneath the seam weld that extends along the top edge of each heat exchanger is a pillowed region 70 where there is an absence of spot welds. A tube 72 extends within the region 70 at the top of the heat exchanger substantially the entire width of the heat exchanger, and further extends outwardly from the heat exchanger through an opening 74 in the edge of the heat exchanger near the top seam. Within the region 70 the tube 72 has openings 76 in the wall of the tube. The openings face upwardly and are spaced along substantially the entire portion of the tube within the heat exchanger. By way of example, the tube 72 may be ¼ inch O.D. and the openings 76 may be 3/64 inch in diameter and spaced at approximately two inch intervals. The end of the tube 72 outside of the heat exchanger is connected through appropriate plumbing 80 and 34, and a valve 28 to the refrigeration system 22.

The purpose of the tubes 72 and associated valves and plumbing is to deliver cold refrigerant to the interior passages of the heat exchangers during the refrigeration cycle. After a predetermined accumulation of ice on the outer surfaces of the plates 62 and 64 of each heat exchanger the system controller 24 controls the various valves to interrupt the feeding of cold refrigerant through the tube 72 into the heat exchangers, and instead delivers hot gas refrigerant to the interior passages of the heat exchangers to release the ice from the outside surfaces and allow it to fall into the storage tank. This hot gas is delivered to each heat exchanger by way of a sleeve or tube 82 that extends outwardly from the inlet opening 74 and is suitably secured such as by welding at the inlet to seal the opening. The sleeve 82 surrounds the tube 72 to define therebetween an annular chamber 84. A T-fitting 86 is secured to the end of the sleeve and is connected by feed lines 88 and 32, and a valve 26 to the refrigeration system 22. The end of the sleeve has a cap 90 with a central opening 92 through which the tube 72 extends. The tube 72 is suitably secured in the opening 92 such as by a weld to seal the chamber 84. Hence, the chamber 84 communicates with the interior passages of the heat exchanger as do the openings 76 in the tube 72.

A tube 100 covers the top edge of the heat exchanger and presents an upper rounded surface 102. The tube 100 may be plastic and may have a slit 104 in the tube wall along its entire length. The tube is placed over the upper edge of the heat exchanger with the upper edge extending through the slit 104. As will be further explained, the upper rounded surface 102 of the tube acts to distribute the flow of water evenly to both sides of the heat exchanger. Each heat exchanger also has hangers 110 which may be in the form of stub pipes extending outwardly from the side edges of the heat exchanger. Each heat exchanger is in effect hung on the frame with the hangers 110 resting on frame members 112. Each heat exchanger is secured in position by suitably attaching it to appropriate frame members.

A refrigerant outlet 120 is located at a side edge near the bottom of each heat exchanger. The outlet is connected by feed pipes 122 and 36, and a valve 30 to the refrigeration system 22. A bypass line 124 removes liquid refrigerant from the heat exchanger during the harvest (defrost) cycle.

The water reservoir 18 of each module is directly above the heat exchangers and includes a pan 130 suitably supported by the frame and a removable lid 132. The bottom of the pan has rows 134 of holes 136. The rows are located directly above the upper edges of the heat exchanger and are vertically aligned with the longitudinal axes of the tubes 102. The holes in each row are spaced along substantially the entire width of the heat exchanger. Within each pan is a rectangular trough 140 spaced from the bottom of the pan and extending between the pan's side walls. The trough 140 has openings 144 spaced along substantially its entire length. The openings are located on both sides of the trough where its bottom wall and side walls meet. See FIGS. 5–7. A water feed pipe 148 is connected to a side wall of the trough at an intermediate location. The feed pipe 148 is connected to th feed lines 54 to receive water by way of the valve 52.

Hence, water delivered through the feed pipes 54 and 148 to the troughs is distributed through the openings 144 across the widths of the pans. From there the water is distributed through the openings 136 in the bottoms of the pans and onto the upper rounded surfaces 102 at the tops of the heat exchangers.

By way of operation, water delivered to the reservoirs is distributed through the holes in the bottoms of the reservoirs onto the rounded upper surfaces at the tops of the heat exchangers. From there the water flows over both sides of the rounded surfaces and evenly over the outer surfaces of the heat exchangers. During the refrigeration cycle cold refrigerant is fed through the tubes 72 and openings 76 into the interiors of the heat exchangers near the tops. From there the cold refrigerant cascades downwardly through the interior passages and over the interior surfaces of the heat exchangers. This, of course, freezes the water producing ice on the outer surfaces. The ice is allowed to build up to a prescribed thickness. By way of example that thickness may be approximately 5/16 inch. When the ice builds to the prescribed thickness the system controller places the refrigeration system in a harvest (defrost) cycle interrupting the delivery of cold refrigerant to the heat exchangers and instead delivering hot gas refrigerant to the interior passages by way of the chambers 84. This releases the ice sheets from the exterior surfaces allowing them to fall into the storage tank below.

The heat exchanger assembly of the present invention, particularly with the tubes 72 having the spaced openings 76 for the even distribution of cold refrigerant within the heat exchangers, provides high efficiency with simple construction and low cost. The result is the efficient production of ice with exceptionally uniform thickness over substantially the entire outer surfaces of the heat exchangers. By way of example, machines of the type to which this invention relates may produce over 300 tons of ice per day.

There are various changes and modifications which may be made to the invention as would be apparent to those skilled in the art However, these changes or modifications are included in the teaching of the disclosure, and it is intended that the invention be limited only by the scope of the claims appended hereto.

We claim:

1. In an ice harvesting/water chiller machine having a storage tank for collecting and storing ice or chilled water produced by the machine, and a refrigeration system for producing the ice and depositing it into the storage tank, an improved evaporator assembly comprising:

a plurality of plate-type heat exchangers, said heat exchangers being oriented vertically in face-to-face, parallel, relation above said tank, a water reservoir above said heat exchangers, means for distributing water from said reservoir downwardly to flow over the outside surfaces of said heat exchangers to affect a substantially even distribution of water over said outside surfaces as it flows downwardly thereover, and means for distributing cold refrigerant to the tops of said heat exchangers to cascade downwardly over the inside surfaces of said heat exchangers to affect a substantially even distribution of refrigerant over said inside surfaces as it cascades downwardly thereover, said refrigerant distribution means further comprising a cold refrigerant feed tube extending across the top of each heat exchanger substantially the entire width thereof, said tube having spaced openings along the tube over substantially the entire width of the heat exchanger which openings communicate with the interior of said heat exchanger, said tube receiving cold refrigerant and distributing it through said openings into the interior of the heat exchanger to cascade downwardly over the inside surfaces thereof.

2. In the ice harvesting/water chiller machine of claim 1 wherein said heat exchangers are of the pillowed type formed of multiple sheets spot welded together in uniform spacings over substantially the entire sheets and then inflated to pillow the sheets between the spot welds to define interior passages between the sheets for the flow of refrigerant therethrough.

3. In the ice harvesting/water chiller machine of claim 1 wherein said evaporator assembly further comprises means for cycling hot gas refrigerant into the heat exchangers to release the ice formed thereon.

4. In the ice harvesting/water chiller machine of claim 3 wherein said cold refrigerant feed tube extends outwardly beyond an edge of said heat exchanger, and further comprising a sleeve surrounding said cold refrigerant feed tube and defining an annular chamber therebetween which communicates with the interior of said heat exchanger, and means for cycling hot gas refrigerant into said heat exchanger by way of said chamber.

5. In the ice harvesting/water chiller machine of claim 1 wherein the top of each heat exchanger has a rounded surface over substantially the entire width of the heat exchanger, said reservoir having openings directly above the top of each heat exchanger spaced over substantially the entire width of the heat exchanger through which water flows from the reservoir onto the top of the rounded surface and then over the rounded surface and down both sides of the heat exchanger.

6. In the ice harvesting/water chiller machine of claim 4 wherein said heat exchangers are of the pillowed type formed of multiple sheets spot welded together in uniform spacings over substantially the entire sheets and then inflated to pillow the sheets between the spot welds to define interior passages between the sheets for the flow of refrigerant therethrough.

* * * * *